US005493261A

United States Patent [19]

Kitoh et al.

[11] Patent Number: 5,493,261

[45] Date of Patent: Feb. 20, 1996

[54] DIELECTRIC FILTER USING QUARTER WAVELENGTH COAXIAL DIELECTRIC RESONATORS CONNECTED IN SERIES

[75] Inventors: Ryozo Kitoh; Yoshiaki Fujiyama; Takaki Ono; Atsunori Takasugi; Shotaro Hayashi, all of Yamaguchi, Japan

[73] Assignee: Ube Industries, Ltd., Yamaguchi, Japan

[21] Appl. No.: 279,471

[22] Filed: Jul. 22, 1994

Related U.S. Application Data

[63] Continuation of Ser. No. 920,593, filed as PCT/JP91/-1751, Dec. 24, 1991, abandoned.

[30] Foreign Application Priority Data

| | | | |
|---|---|---|---|
| Dec. 26, 1990 | [JP] | Japan | 2-414043 |
| Feb. 4, 1991 | [JP] | Japan | 3-035645 |
| Feb. 13, 1991 | [JP] | Japan | 3-040635 |

[51] Int. Cl.[6] ..... H01P 1/202

[52] U.S. Cl. ..... 333/206; 333/222

[58] Field of Search ..... 333/202, 206, 333/207, 222

[56] References Cited

U.S. PATENT DOCUMENTS

| | | | |
|---|---|---|---|
| 4,245,198 | 1/1981 | Nishikawa et al. | 333/206 X |
| 4,703,291 | 10/1987 | Nishikawa et al. | 333/206 X |

FOREIGN PATENT DOCUMENTS

| | | | |
|---|---|---|---|
| 56-057304 | 10/1979 | Japan . | |
| 0065601 | 4/1985 | Japan | 333/202 |
| 61-262301 | 11/1986 | Japan . | |
| 62-128601 | 6/1987 | Japan . | |
| 63-024703 | 2/1988 | Japan . | |
| 01037101 | 2/1989 | Japan . | |
| 02016802 | 1/1990 | Japan . | |

*Primary Examiner*—Benny Lee
*Assistant Examiner*—Justin P. Bettendorf
*Attorney, Agent, or Firm*—Baker & Daniels

[57] ABSTRACT

A dielectric filter having a plurality of λ/4 coaxial dielectric resonators in stages, the resonator being filled with a dielectric material between its inner and outer conductors, comprising at least one stage in which the outer conductor of the λ/4 coaxial dielectric resonator is grounded via a capacitance or inductance. The dielectric filter is embodied as a low-pass filter, high-pass filter or a band-pass filter. As a result, by utilizing dielectric resonators having a desired resonant frequency, it is possible to readily achieve a dielectric filter having an attenuating pole in the neighborhood of the frequency passband and small in insertion loss.

52 Claims, 12 Drawing Sheets

DIELECTRIC FILTER USING QUARTER WAVELENGTH COAXIAL DIELECTRIC RESONATORS CONNECTED IN SERIES

This is a continuation of application Ser. No. 07/920,593, filed as PCT/JP91/01751, Dec. 24, 1991 (abandoned).

FIELD OF THE INVENTION

The present invention relates to a dielectric filter using a quarter wavelength (λ/4) coaxial dielectric resonator and, in particular, to a dielectric filter having an attenuating pole in the neighborhood of frequency passband in its filter frequency characteristic.

The present invention can be applied to a low-pass filer, high-pass filter and band-pass filter in a high frequency range such as a microwave or the like.

BACKGROUND OF THE INVENTION

In general, as the low-pass filter, one having a basic arrangement as shown in FIG. 1 has been known, in which inductances $L_1$, $L_2$, etc each disposed in series are grounded via capacitances $C_{E1}$, $C_{E3}$, $C_{E3}$, etc.

In addition, as a low-pass filter having an attenuating pole formed in the neighborhood of the cut-off frequency for achieving a steep attenuating characteristic, as shown in FIG. 2, one having an arrangement using a parallel connection of a capacitor $C_1$ and a coil $L_1$ and a parallel connection of a capacitor $C_2$ and a coil $L_2$ has been known.

With such a low-pass filter, a stray capacitance as indicated by broken line in FIG. 2 is generated to the LC parallel connection due to the arrangement of the used coil. This stray capacitance is substantially, difficult to remove, and has a considerable distribution. This distribution in turn causes a distribution of the resonant frequency of the LC parallel connection or of the impedance in the frequency pass-band ultimately affecting the filter frequency characteristic.

This effect, although small when the frequency is low, becomes greater if the frequency is high thus causing the fluctuation of the attenuating pole frequency and the cut-off frequency or the increase of the mismatching loss in the frequency passband.

Therefore, unless a considerable adjustment is made to the coil or capacitor, any desired filter frequency characteristic cannot be obtained, and it is complicated and difficult to adjust the filter frequency characteristic.

In addition, in general, as the high-pass filter, one having a basic arrangement as shown in FIG. 3 has been known, in which capacitances $C_1$, $C_2$, etc each disposed in series are grounded via inductances $L_{E1}$, $L_{E2}$, $L_{E3}$ and the like.

In addition, as the high-pass filter having an attenuating pole formed in the neighborhood of the cut-off frequency for achieving a steep attenuating characteristic, as shown in FIG. 4, one having an arrangement using a parallel connection of the capacitor $C_1$ and the coil $L_1$ and a parallel connection of the capacitor $C_2$ and the coil $L_2$ has been known.

However, such a high-pass filter also suffers from a similar problem as in the aforementioned low-pass filter and, unless a considerable adjustment is made to the coil or capacitor, a desired filter frequency characteristic cannot be achieved, and it is complicated or difficult to adjust the filter frequency characteristic.

Further, in general, as the band-pass filter, one having a basic arrangement as shown in FIG. 5 has been known, in which capacitances $C_1$, $C_2$, $C_3$, $C_4$, etc and inductances $L_1$, $L_2$, $L_3$, $L_4$, etc each alternately disposed in series are grounded via capacitances $C_{E1}$, $C_{E2}$, $C_{E3}$, etc.

Still further, as the band-pass filter having an attenuating pole formed in the neighborhood of the frequency passband for achieving a steep attenuating characteristic, as shown in FIG. 6, one having an arrangement using a parallel connection of a capacitor $C_{F1}$ and a coil $L_1$, a parallel connection of a capacitor $C_{F2}$ and a coil $L_2$, a parallel connection of a capacitor $C_{F3}$ and a coil $L_3$, a parallel connection of a capacitor $C_{F4}$ and a coil $L_4$ and the like has been known.

Such a band-pass filter also suffers from a similar problem as in the aforementioned low-pass filter or high-pass filter and, unless a considerable adjustment is made to the coil or capacitor, no desired filter frequency characteristic is obtained and, it is complicated and difficult to adjust the filter frequency characteristic.

Thus, it is proposed to use a λ/4 coaxial dielectric resonator using a dielectric material having a high dielectric constant in order to form a band-pass filter of high frequency range. The arrangement of a conventional band-pass filter using the dielectric resonator is illustrated in FIG. 7, in which 1A', 1B' and 1C' each denote a dielectric resonator, whose outer conductor is grounded. However, according to this arrangement, it is not possible to form the attenuating pole in the neighborhood of the upper or lower limit of the frequency passband to achieve the steep attenuating characteristic while, as the number of stages is increased, the insertion loss can be greatly increased.

SUMMARY OF THE INVENTION

In view of the foregoing circumstances, the present invention has been achieved and, an object of the present invention is to provide a dielectric filter using λ/4 coaxial dielectric resonators and having an attenuating pole on a desired frequency which allows a desired filter frequency characteristic to be readily achieved.

According to the present invention, in order to achieve the foregoing end, there is provided a dielectric filter having a plurality of λ/4 coaxial dielectric resonators connected in stages, a dielectric being filled between its inner and outer conductors, characterized in that it includes at least one stage in which the outer conductor of the resonator is grounded via a capacitance or inductance.

The above-described dielectric filter according to the present invention can be embodied as a filter as follows:

(a) a low-pass filter in which the outer conductor of the λ/4 coaxial dielectric resonator in the at least one stage is grounded via the capacitance while the resonators in adjacent stages are connected to each other.

(b) a high-pass filter in which the outer conductor of the resonator in the at least one stage is grounded via the inductance while the resonators in adjacent stages are connected to each other.

(c) a band-pass filter in which the outer conductor of the resonator in the at least one stage is grounded via the capacitance, and adjacent stages are present in which the inner conductor of one stage is connected to the outer conductor of the other stage via a capacitance.

(d) a band-pass filter in which the outer conductor of the resonator in the at least one stage is grounded via the inductance, and adjacent stages are present in which the inner conductor of one stage is connected to the outer conductor of the other stage via an inductance.

DETAILED DESCRIPTION OF THE PREFERRED EMBODIMENTS

Specific embodiments of the present invention are hereinafter described in greater detail with reference to the accompanying drawings.

(A) Low-pass Filter

Figure 8:
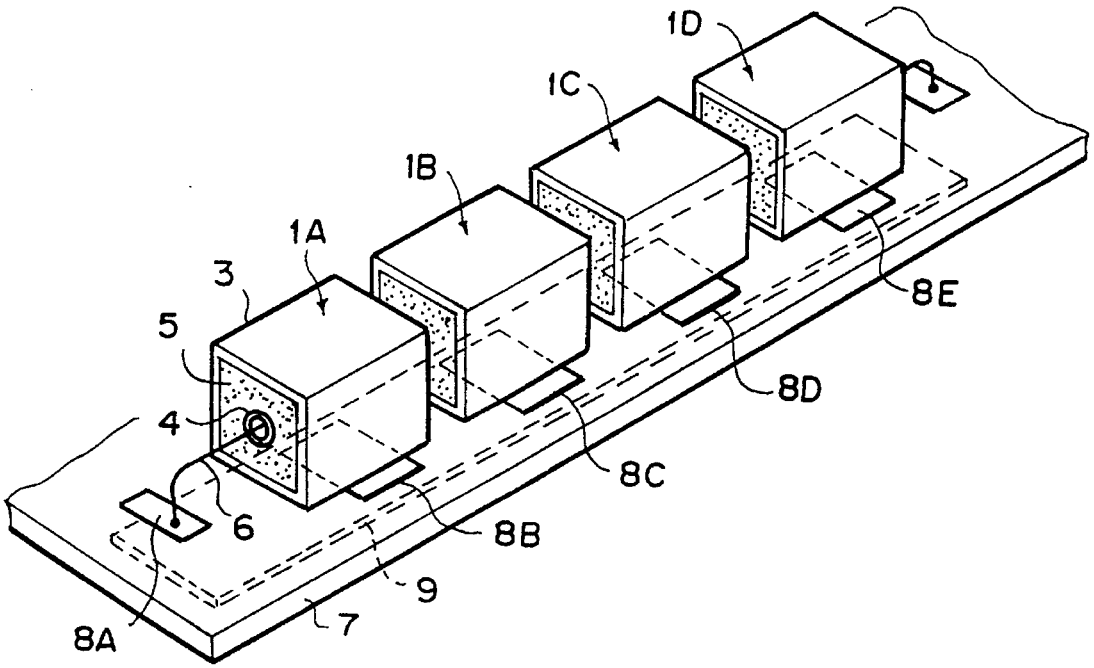
FIG. 8 is a view of the arrangement of a dielectric low-pass filter according to the present invention.

Referring to FIG. 8, by way of example, a four-stage dielectric low-pass filter is shown in which four λ/4 coaxial dielectric resonators 1A, 1B, 1C and 1D are used.

Figure 9:
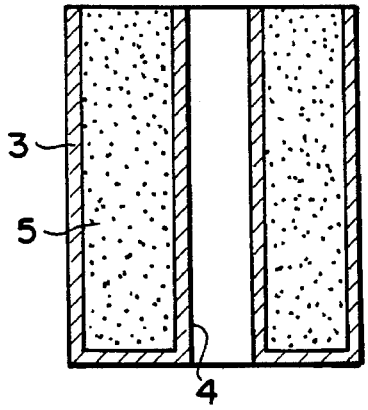
FIG. 9 is a cross-sectional view of a dielectric resonator.

As its cross-sectional view is shown in FIG. 9, the coaxial dielectric resonator is arranged so that a dielectric material 5 (for example, made of a barium titanate series substance of dielectric constant of about 93) is filled between a prismatic outer conductor 3 and a cylindrical inner conductor 4 with the outer and inner conductors 3 and 4 short-circuited at its one end surface, and it resonates when its length equals λ/4 (λ denotes wavelength), as well known.

Figure 10:
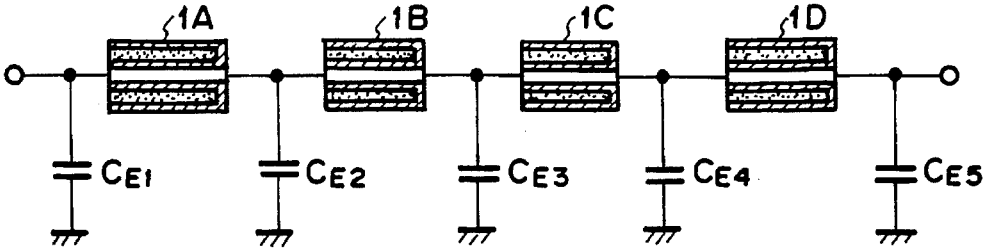
FIG. 10 is an equivalent circuit diagram of the filter of FIG. 8.

Inner conductors 4 of the foregoing resonators 1A, 1, 1C and 1D respectively are connected in series to each other via a lead 6. Each of the resonators is supported on the upper surface of a dielectric substrate 7 made of, for example, a polytetrafluoraethylene On the upper surface of the substrate 7, there are formed an electrode 8A of desired size connected to a lead 6 connected to the inner conductor of the resonator 1A and electrodes 8B, 8C, 8D and 8E of desired size connected to the outer conductor 3 of each resonator. Further, on the lower surface of the substrate 7, a single grounded electrode 9 is formed opposed to the foregoing electrodes 8A through 8E. Capacitances $C_{E1}$, $C_{E2}$, $C_3$, $C_{E4}$ and $C_{E5}$ are each arranged by these electrodes 8A through 8E and the grounded electrode 9. FIG. 10 illustrates the equivalent circuit.

In such an arrangement, the frequency of the attenuating pole of the foregoing dielectric filter is determined by the resonant frequency of the dielectric resonator, and the frequency range and its depth ranging from the cut-off frequency up to the attenuating pole are determined by the characteristic impedance of the resonator and the capacitances $C_{E1}$ through $C_{E5}$.

Figure 11:
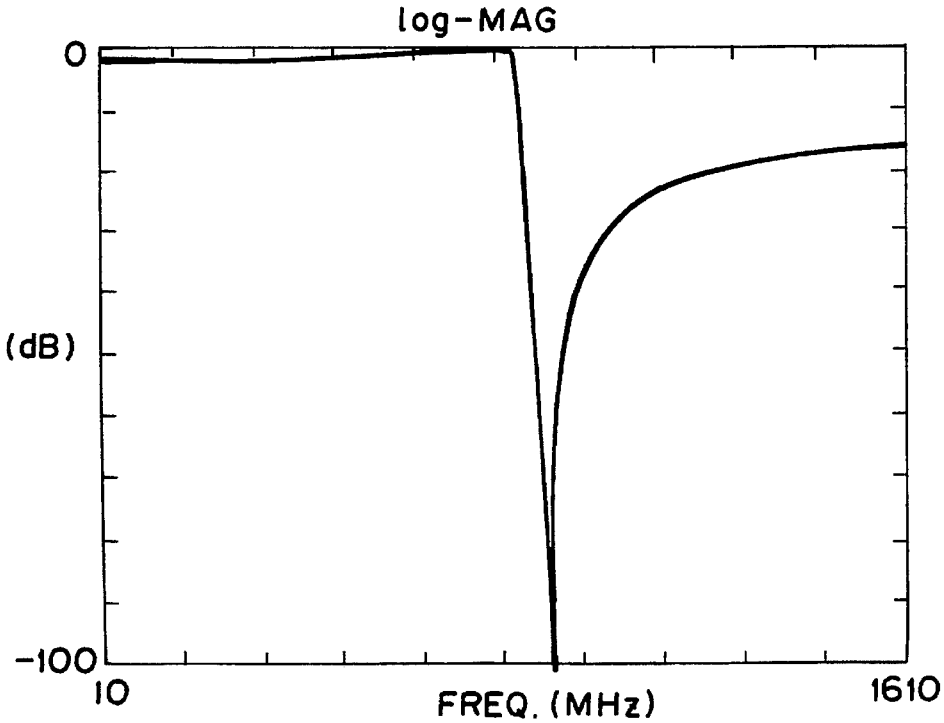
FIG. 11 is a diagram of the filter frequency characteristic of the filter of FIG. 8.

FIG 11 illustrates a specific example of the filter frequency characteristic according to this embodiment, in which the characteristic impedance $Z_o$ of the dielectric resonators 1A, 1B, 1C and 1D was equal to 10 Ω, the resonant frequency $F_o$ 900 MHz, $C_{E1}=C_{E5}=2.5$ pF, $C_{E2}=C_{E4}=4$pF, $C_{E3}=3$ pF.

Figure 1:
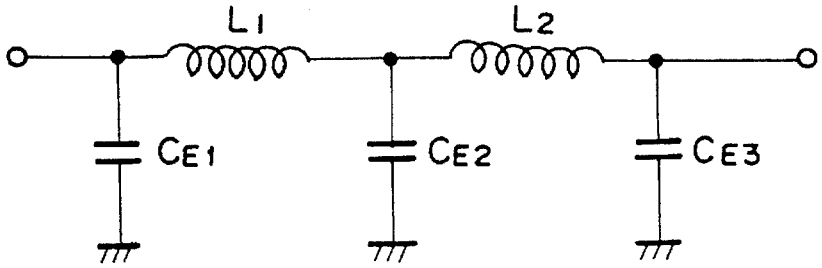
FIG. 1 PRIOR ART
FIGS. 1 through 7 are respectively a view of the arrangement of a conventional filter.
Figure 2:
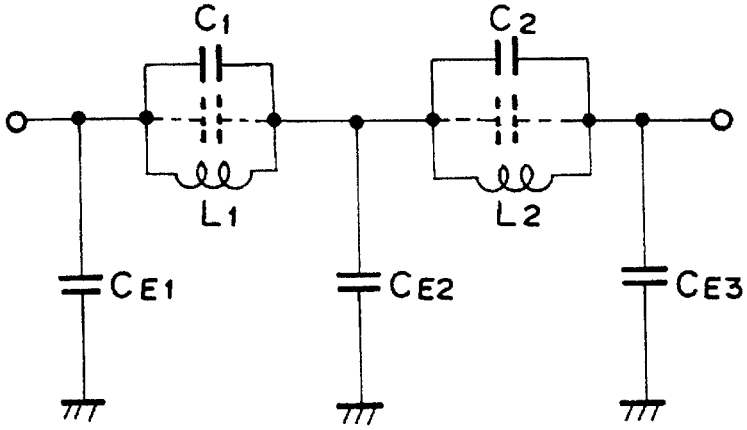
FIG. 2 PRIOR ART
Figure 3:
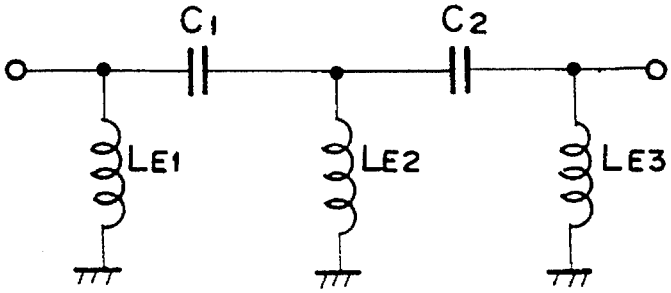
FIG. 3 PRIOR ART

In such a low-pass filter, since the foregoing coaxial dielectric resonator has substantially no stray capacitance caused by the LC parallel connection, as indicated by broken line in FIG. 2, its filter frequency characteristic is stable. In addition, since the foregoing capacitances $C_{E1}$ through $C_{E5}$ can be adjusted including the stray capacitance between the outer conductor of the dielectric resonator and the ground, it is extremely easy to adjust the filter frequency characteristic.

(B) High-pass Filter

Figure 12:
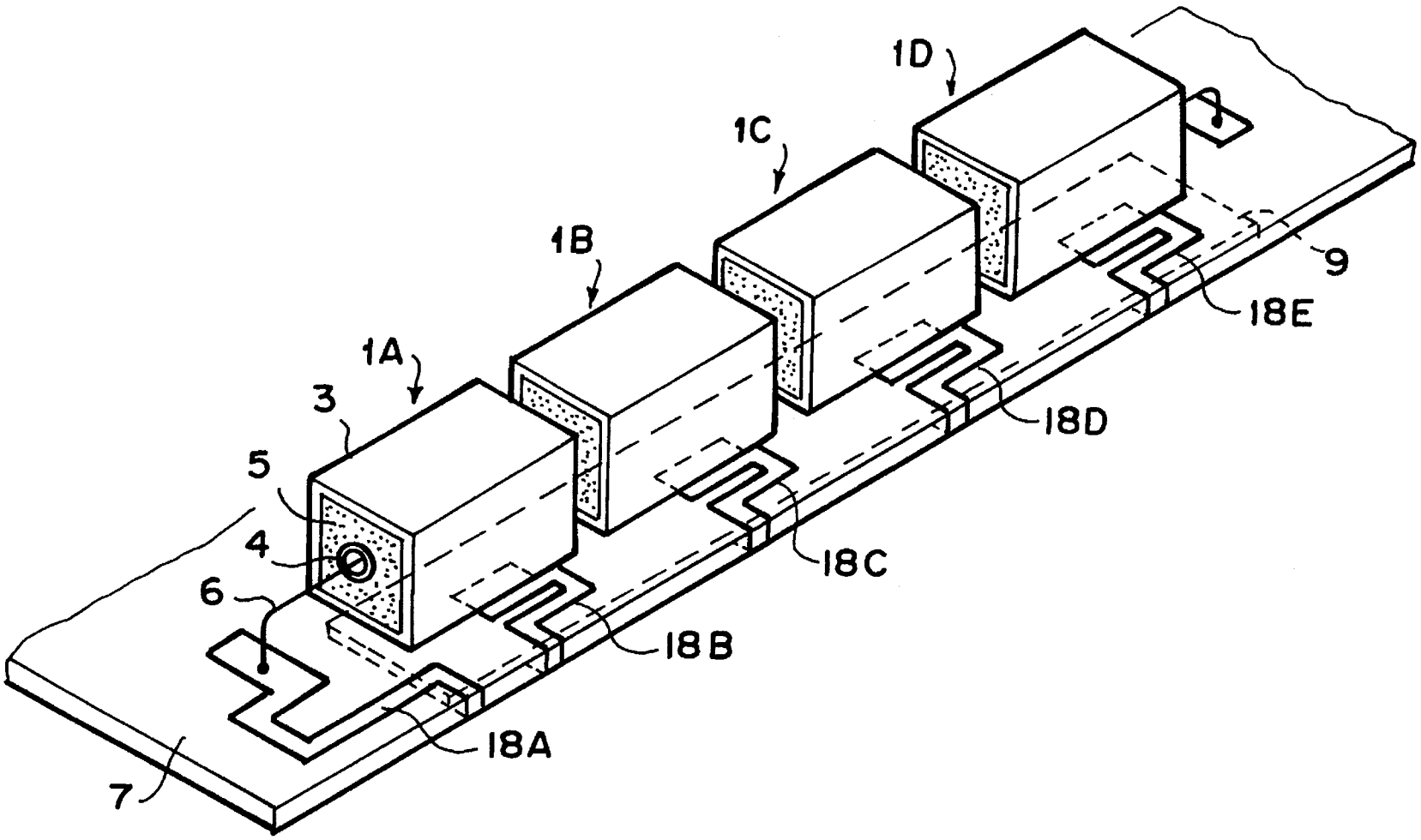
FIG. 12 is a view of the arrangement of a dielectric high-pass filter according to the present invention.
Figure 13:
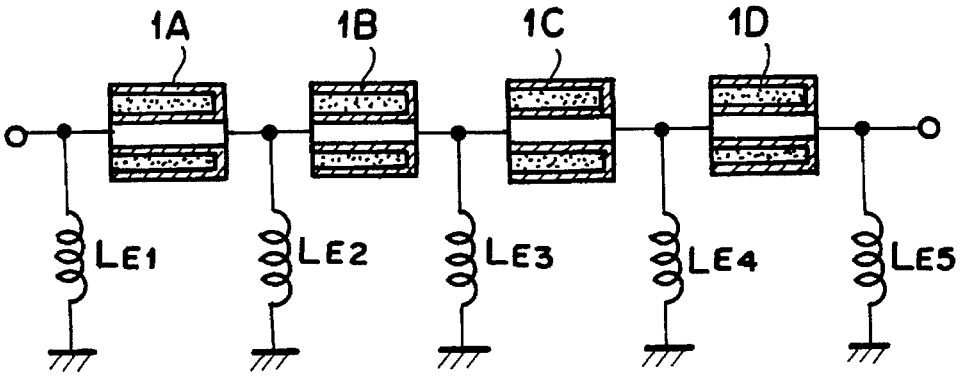
FIG. 13 is an equivalent circuit diagram of the filter of FIG. 12.

FIG. 12, by way of example, illustrates a four-stage dielectric high-pass filter arranged by using four λ/4 coaxial dielectric resonators 1A, 1B, 1C and 1D. Here, the inner conductor 4 of the coaxial dielectric resonator is connected in series via the lead 6. On the upper surface of the substrate 7 on which each resonator is supported, a pattern coil 18A of desired size connected to the lead 6 connected to the inner conductor of the resonator 1A and pattern coils 18B, 18C, 18D and 1BE of desired size connected to the outer conductor 3 of each resonator are formed to thereby form inductances $L_{E1}$, $L_{E2}$, $L_{E3}$, $L_{E4}$ and $L_{E5}$. The equivalent circuit is illustrated in FIG. 13.

With such an arrangement, the frequency of the attenuating pole of the foregoing dielectric filter is determined by the resonant frequency of the dielectric resonator, and the frequency range and its depth ranging from the cut-off frequency up to the attenuating pole are determined by the characteristic impedance of the resonator and the inductances $L_{E1}$ through $L_{E5}$.

Figure 14:
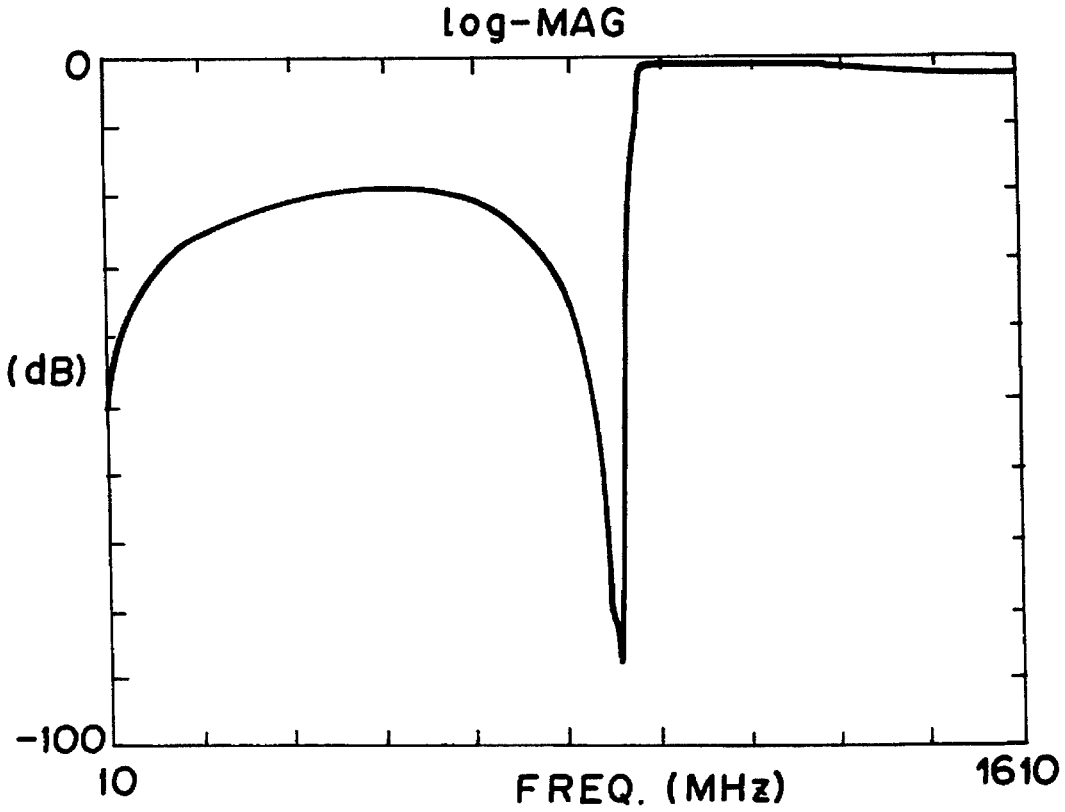
FIG. 14 is a diagram of the filter frequency characteristic of the filter of FIG. 12.

FIG. 14 illustrates a specific example of the filter frequency characteristic according to this embodiment. Here, the characteristic impedance $Z_o$ of the dielectric resonators 1A, 1B, 1C and 1D was 10Ω, the resonant frequency $F_o$ 900 MHz, $L_{E1}=L_{E5}=15$ nH, $L_{E2}=L_{E4}=10$ nH, $L_{E3}=13$ nH.

Figure 4:
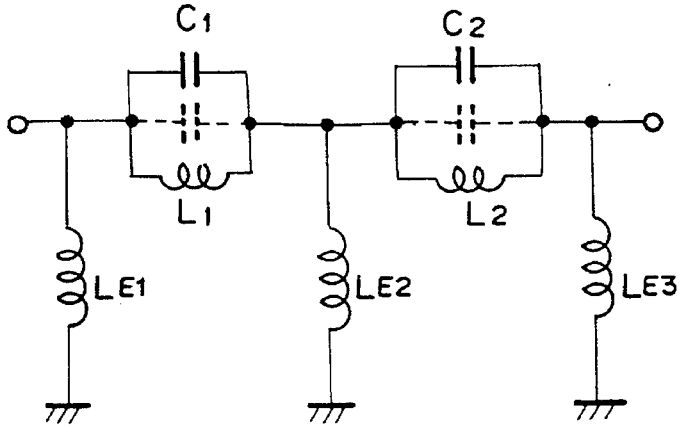
FIG. 4 PRIOR ART
Figure 5:
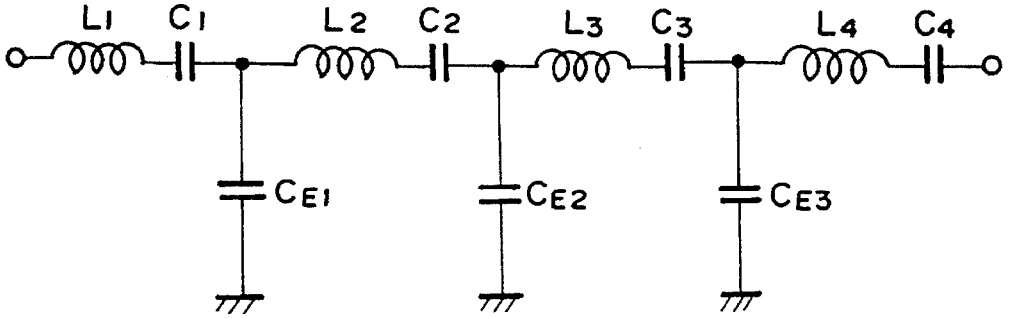
FIG. 5 PRIOR ART

In such a high-pass filter, since the foregoing coaxial dielectric resonator has substantially no stray capacitance caused by parallel connection, as indicated by broken line in FIG. 4, its filter frequency characteristic is stable. In addition, since the foregoing inductances $L_{E1}$ through $L_{E5}$ can be adjusted including the stray capacitance between the outer conductor of the dielectric resonator and the ground, it is extremely easy to adjust the filter frequency characteristic.

(C) Band-pass Filter

Figure 15:
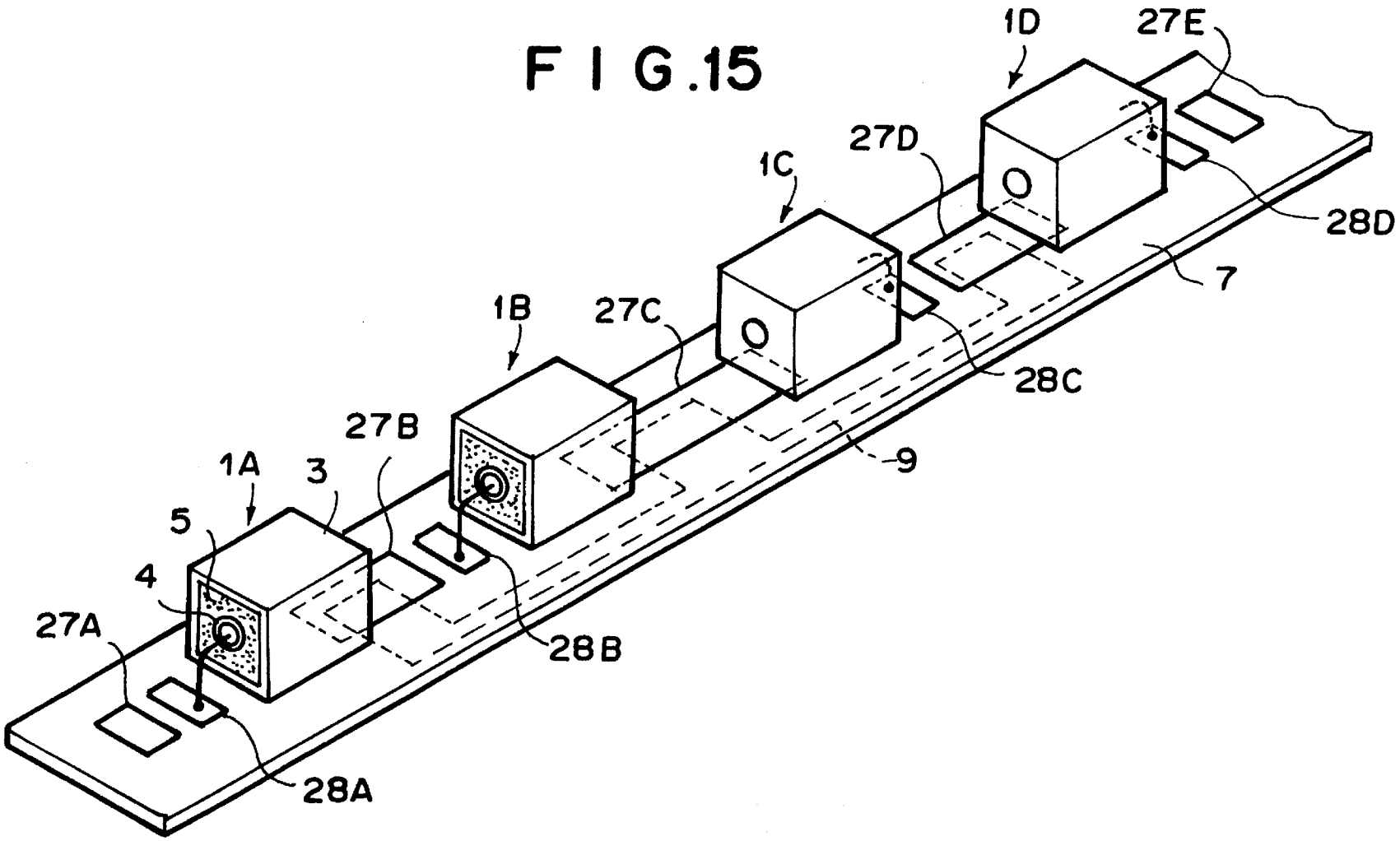
FIG. 15 is a view of the arrangement of a dielectric band-pass filter according to the present invention.
Figure 16:
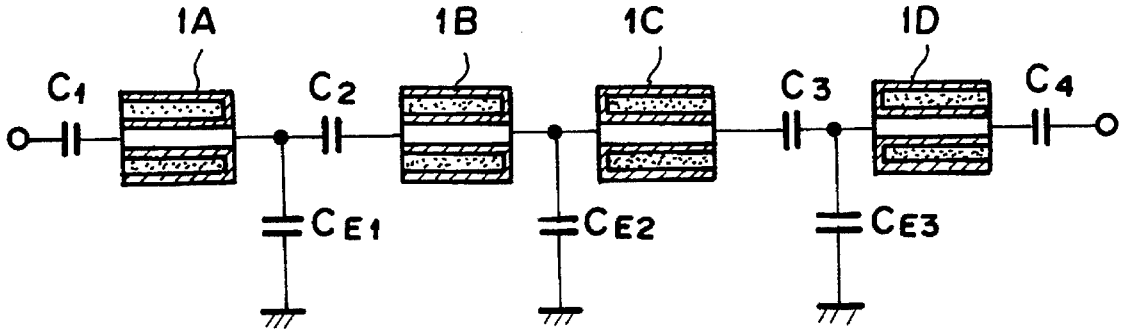
FIG. 16 is an equivalent circuit diagram of the filter of FIG. 15.

FIG. 15 illustrates a four-stage dielectric band-pass filter arranged by using four λ/4 coaxial dielectric resonators 1A, 1B, 1C and 1D. Here, on the upper surface of the substrate 7 on which the resonator is supported, electrodes 27A, 27B, 27C, 27D, 27E, 28A, 28B, 28C and 28D are formed. Electrodes 27B, 27C and 27D are connected to the outer conductor 3 of each resonator, and opposed to these electrodes, a single grounded electrode 9 is formed on the lower surface of the substrate 7. Capacitances $C_{E1}$, $C_{E2}$ and $C_{E3}$ are arranged by these electrodes 27B, 276 and 27D and the grounded electrode 9. In addition, electrodes 28A, 28B, 286 and 28D are each connected to the inner conductor 4 of each resonator by means of a lead, and electrodes 27A and 27E each serve as an input/output terminal. A pair of electrodes 27A and 28A, a pair of electrodes 27B and 28B, a pair of electrodes 27D and 286 and a pair of electrodes 27E and 28D each form capacitances $C_1$, $C_2$, $C_3$ and $C_4$. The equivalent circuit is shown in FIG. 16.

With such an arrangement, the frequency of the attenuating pole of the foregoing dielectric filter is determined by the resonant frequency of the dielectric resonator, and the frequency range and its depth ranging from the upper limit of the frequency passband up to the attenuating pole are determined by the characteristic impedance of the resonator and the capacitances $C_1$, $C_2$, $C_3$, $C_4$, $C_2$, $C_{E2}$ and $C_{E3}$.

Figure 17:
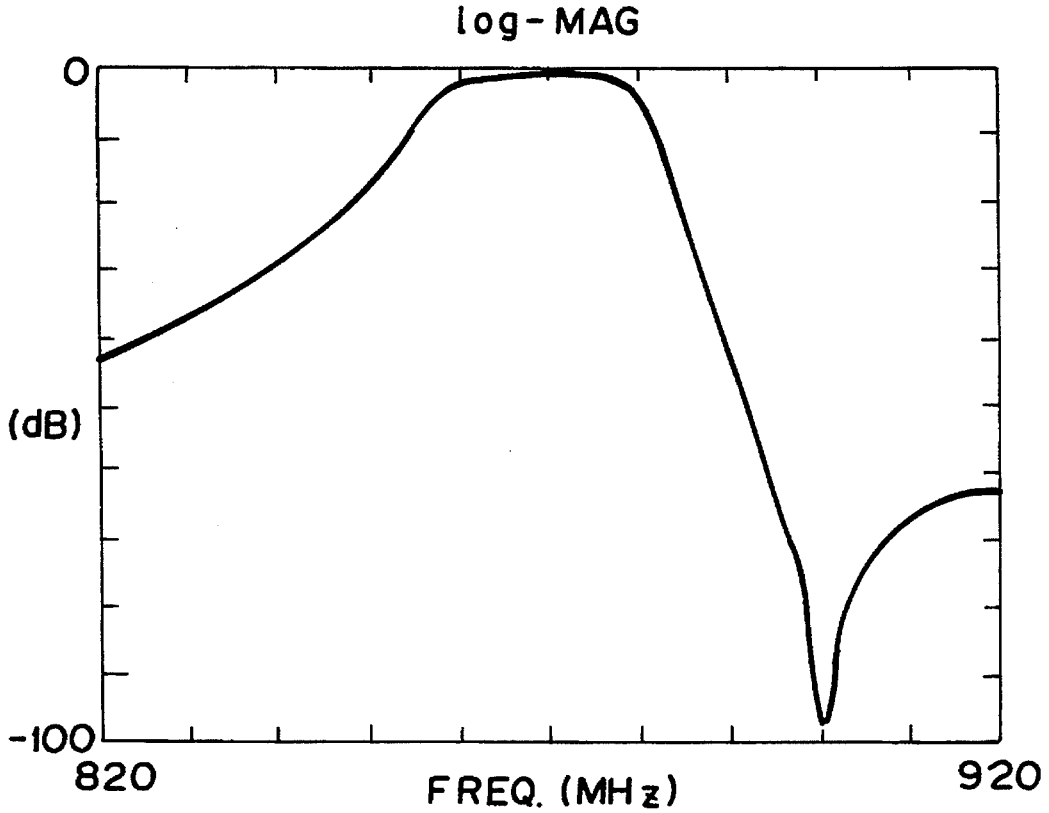
FIG. 17 is a diagram of the filter frequency characteristic of the filter of FIG. 19.

FIG. 17 illustrates a specific example of the filter frequency characteristic according to this embodiment. Here, the characteristic impedance $Z_o$ of the dielectric resonators 1A, 1B, 1C and 1D was 7 Ω, the resonant frequency $F_O$ 900 MHz, $C_{E1}$= $C_{E3}$=4.5 pF , $C_{E2}$=5.8 pF, $C_1$=$C_4$=1.5 pF and $C_2$=$C_3$=2 pF.

Figure 6:
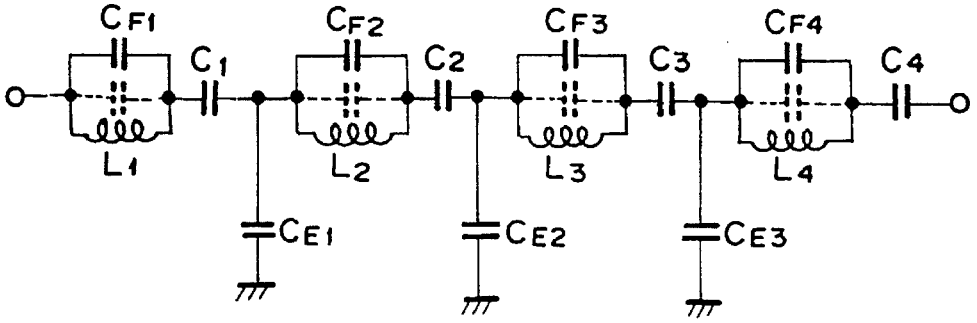
FIG. 6 PRIOR ART

With such a band-pass filter, since the foregoing coaxial dielectric resonator has substantially no stray capacitance caused by the LC parallel connection, as indicated by broken line in FIG. 6, its filter frequency characteristic is stable. In addition, since the foregoing capacitances $C_{E1}$ through $C_{E3}$ can be adjusted including the stray capacitance between the outer conductor of the dielectric resonator and the ground, it is extremely easy to adjust the filter frequency characteristic.

Figure 18:
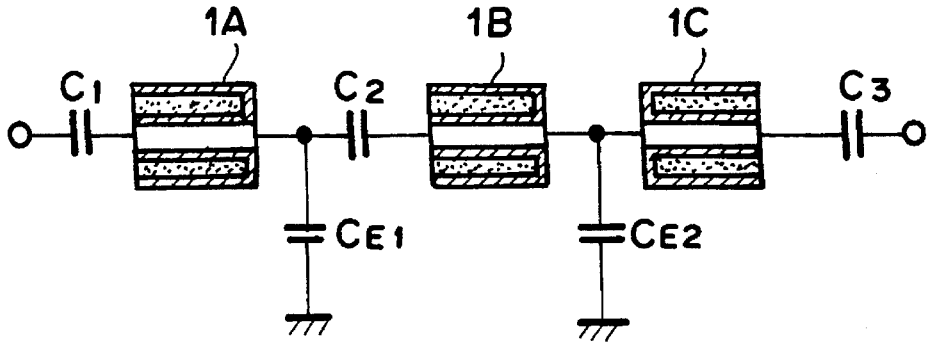
FIG. 18 is a view of the arrangement of another band-pass filter according to the present invention.
Figure 19:
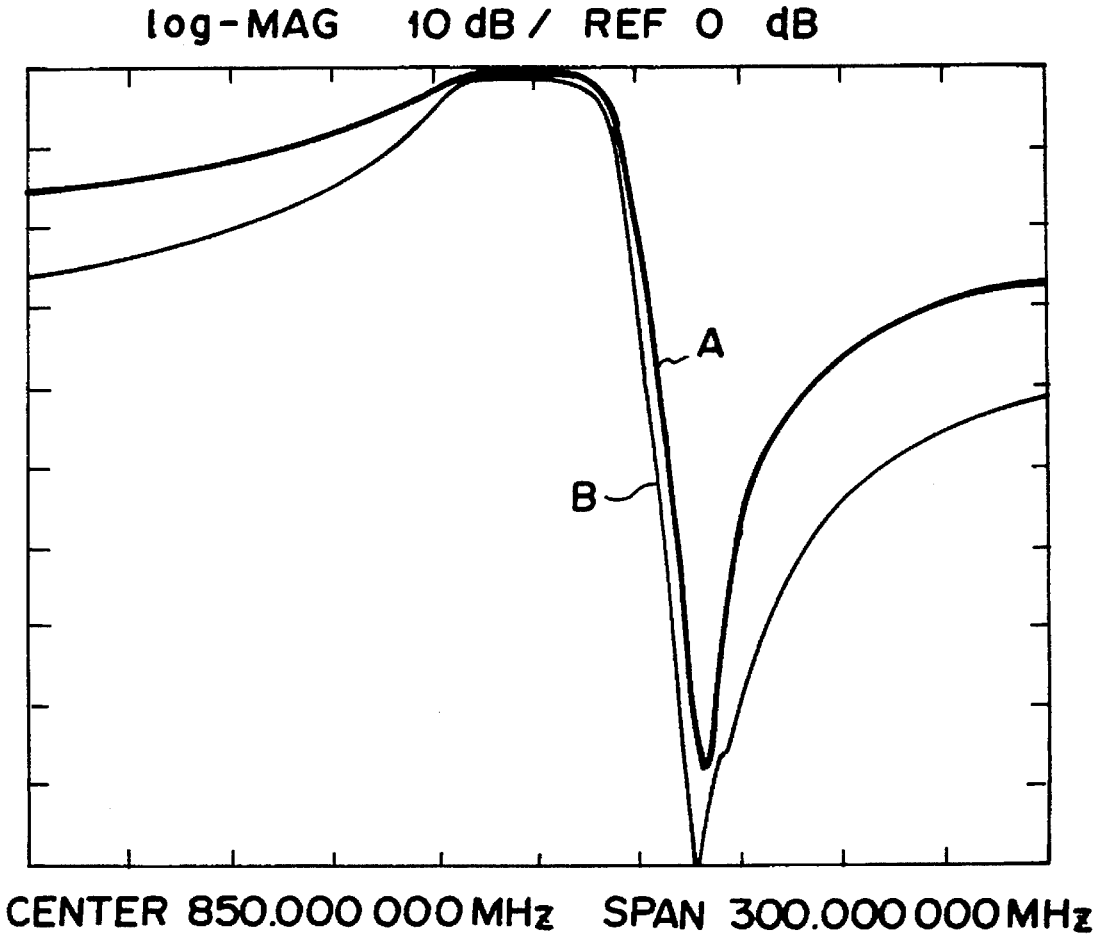
FIG. 19 is a diagram for comparing the characteristics of the filter of FIG. 15 and that of FIG. 18.

The band-pass filter according to this embodiment is extremely small in insertion loss. Here, let us compare the characteristics of a three-stage band-pass filter of FIG. 18 and the four-stage band-pass filter of FIG. 16. FIG. 19 illustrates an example of the result obtained by the foregoing comparison. Here, in the three-stage filter of FIG. 18, the characteristic impedance $Z_O$ of the dielectric resonators 1A, 1B and 1C was 8.3 Ω, the resonant frequency $F_O$ 900 MHz, $C_{E1}$=$C_{E2}$=4.2 pF, $C_1$=$C_3$=2.1 pF, $C_2$=4.1 pF, and, in the four-stage filter of FIG. 16, the characteristic impedance $Z_O$ of the dielectric resonator 1A, 1B, 1C and 1D was 8.3 Ω, the resonant frequency $F_O$ 900 MHz, $C_{E1}$=$C_{E3}$=4.4 pF, $C_{E2}$=5.7 pF, $C_1$=$C_4$=2.1 pF. Referring to FIG. 19, A indicates the characteristic of the the-stage filter, B that of the four-stage filter. In .the characteristic of this figure, for the three-stage filter, the loss value at the frequency at which the magnitude of the insertion loss becomes minimal equals 0.85 dB and, for the four-stage filter, the loss value at the frequency at which the magnitude of the insertion loss becomes minimal equals 1.20 dB, which is extremely small.

Figure 7:
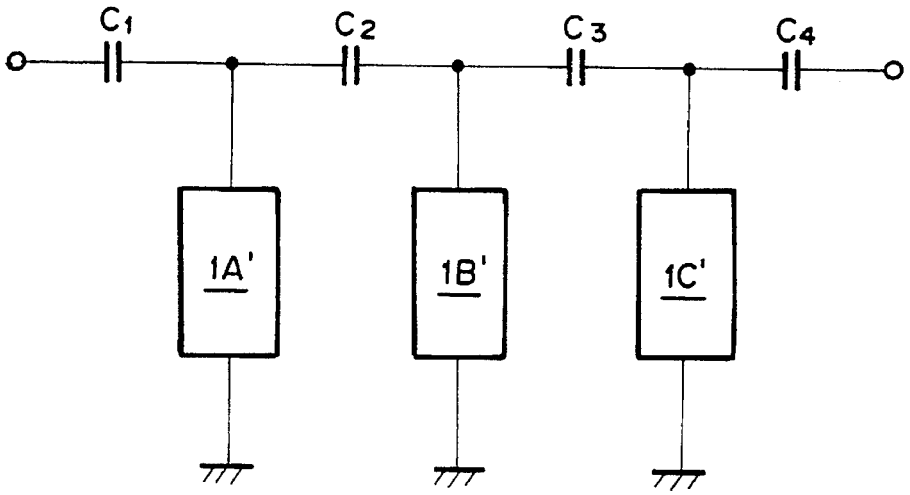
FIG.7 PRIOR ART
Figure 20:
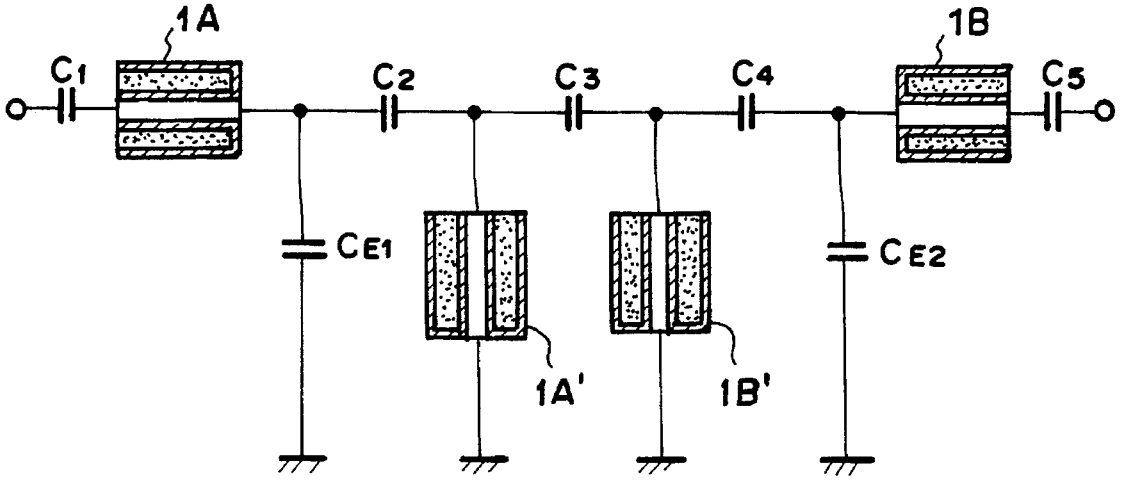
FIG. 20 is a view of the arrangement of a still another dielectric band-pass filter according to the present invention.

FIG. 20 illustrates, by way of example, a four-stage dielectric band-pass filter arranged by using four λ/4 coaxial dielectric resonators 1A, 1B, 1A' and 1B', in which two central stages connect the capacitances $C_2$, $C_3$ and $C_4$ to the λ/4 coaxial dielectric resonators 1A' and 1B' and the outer conductor of the dielectric resonator is directly grounded. That is, in this embodiment, a similar arrangement as in the conventional filter stage of FIG. 7 is used for part of the stages, in which embodiment, a useful attenuating pole can also be formed.

Figure 21:
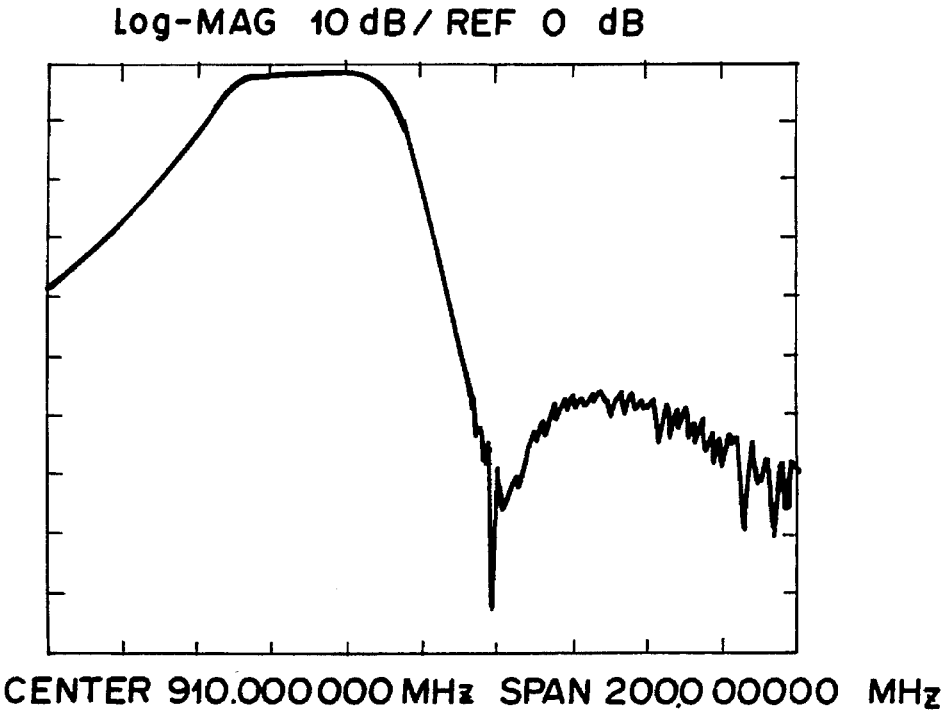
FIG. 21 is a diagram of the filter frequency characteristic of the filter of FIG. 20.

FIG. 21 illustrates a specific example of the filter frequency characteristic according to this embodiment, in which the characteristic impedance $Z_o$ of the dielectric resonators 1A and 1B was 6.14Ω, the resonant frequency $F_o$ 925.5 MHz while the characteristic impedance $Z_o$ of the dielectric resonators 1A' and 1B' was 7.95Ω, the resonant frequency $F_o$ 930 MHz, $C_{E1}$=$C_{E2}$=3 pF, $C_1$=$C_2$=$C_4$=$C_5$=2 pF, $C_3$=0.5 pF.

Figure 22:
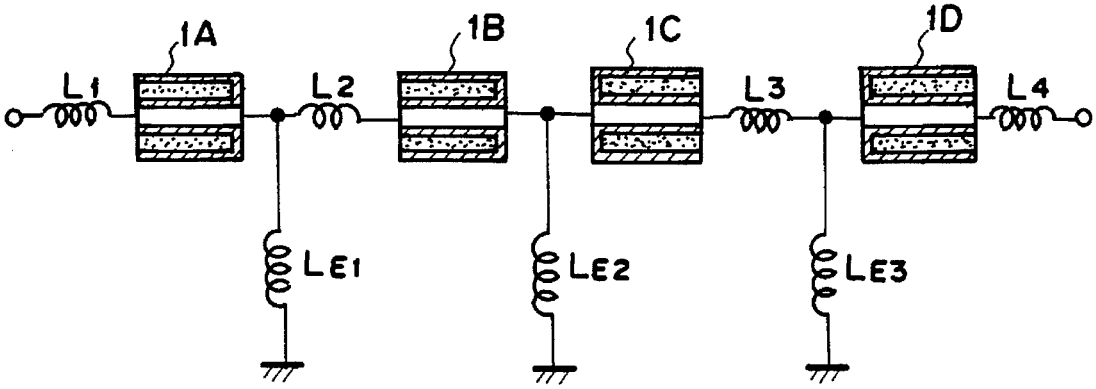
FIG. 22 is a view of the arrangement of a dielectric band-pass filter according to the present invention.
Figure 23:
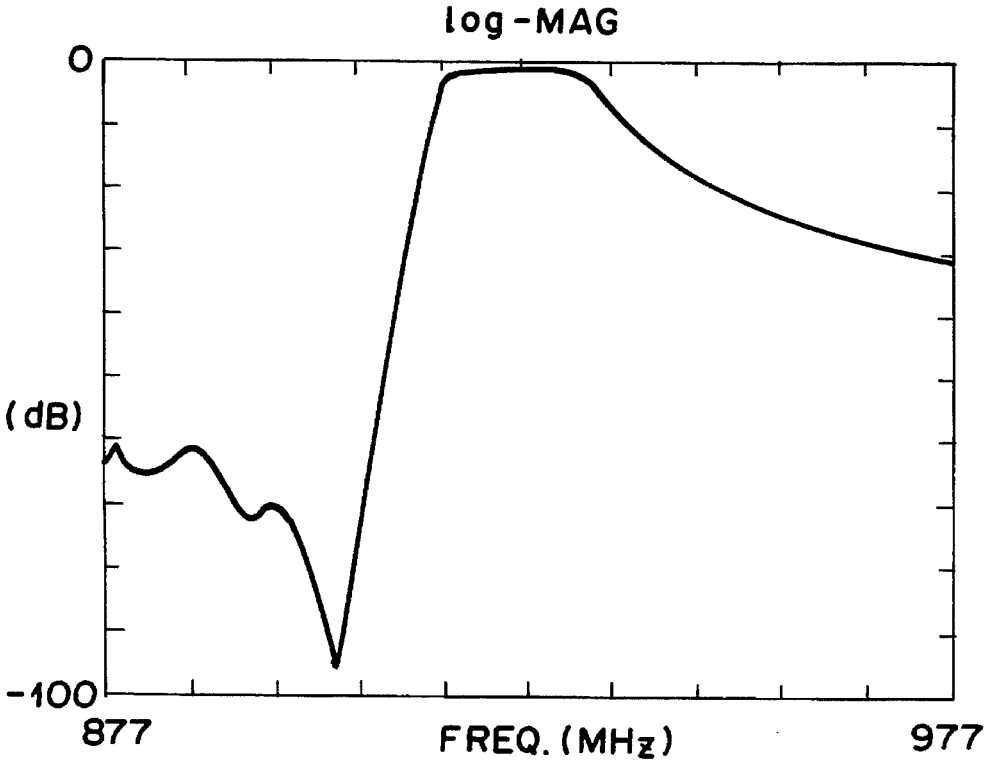
FIG. 23 is a diagram of the filter frequency characteristic of the filter of FIG. 22.

Incidentally, in the foregoing embodiment, the inner conductor and outer conductor of the adjacent dielectric resonators are connected via the capacitor, and the outer conductor of the dielectric resonator is grounded via the capacitors so that the attenuating pole may be available at a frequency higher than the upper limit of the frequency passband. However, in place of these capacitors, coils may be used to form a band-pass filter having the attenuating pole at a frequency lower than the lower limit of the frequency passband.

for example, as shown in FIG. 22, coils $L_1$, $L_2$, $L_3$ and $L_4$ may be connected to the dielectric resonators 1A, 1B, 1C and 1D while the outer conductor of the dielectric resonator may be grounded via coils $L_{E1}$, $L_{E2}$ and $L_{E3}$ so that a characteristic as shown in FIG. 23 may be achieved. In FIG. 23, the characteristic impedance $Z_O$ of the dielectric resonators 1A, 1B, 1C and 1D was 7 Ω, the resonant frequency $F_O$ 900 MHz, $L_{E1}$=$L_{E3}$=7.44 nH, $L_{E2}$=5.77 nH, $L_1$=$L_4$=22.3 nH, $L_2$=$L_3$ =16.73 nH.

Figure 24:
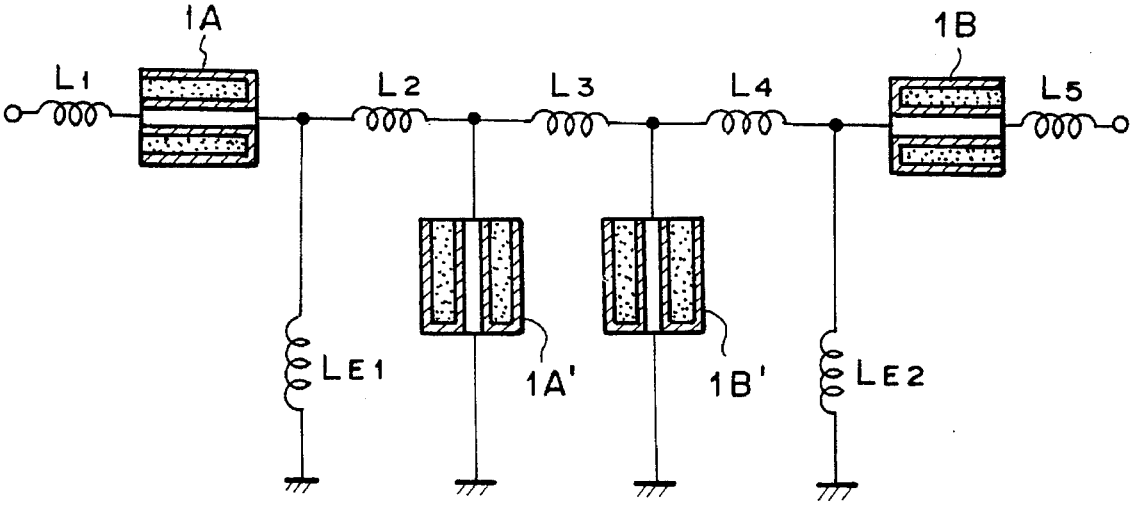
FIG. 24 is a view of the arrangement of still another dielectric band-pass filter according to the present invention.

FIG. 24 illustrates, by way of example, a four-stage dielectric band-pass filter arranged by using four λ/4 coaxial dielectric resonators 1A, 1B, 1A' and 1B', in which two central stages connect the inductances $L_2$, $L_3$ and $L_4$ to the λ/4 coaxial dielectric resonators 1A' and 1B', and the outer conductor of the dielectric resonator is directly grounded.

As described above, according to the present invention, since at least one stage is included in which the outer conductor of the λ/4 coaxial dielectric resonator is grounded via the capacitances or inductances, it is possible to readily achieve a dielectric filter having the attenuating pole in the neighborhood of the frequency passband and small in insertion loss by utilizing the dielectric resonators of desired resonant frequency.

The dielectric filter according to the present invention can be effectively used as the low-pass filter, high-pass filter and the band-pass filter in the high frequency range such as the microwave or the like.

What is claimed is:

1. Dielectric filter having a plurality of λ/4 coaxial dielectric resonators, each resonator having inner and outer conductors and being filled with a dielectric material between said inner and outer conductors, the inner and outer conductors being short-circuited at one end surface of each resonator, wherein the resonators are connected in series so that the inner conductor at said one end surface of one of two neighboring resonators is electrically connected to the inner conductor at the other end surface of the other resonator, and the outer conductor of each resonator is grounded via a respective capacitor.

2. Dielectric filter as set forth in claim 1, wherein all of said dielectric resonators are supported on a dielectric substrate.

3. Dielectric filter as set forth in claim 1, wherein all of said dielectric resonators are supported on a first surface of a dielectric substrate, and the capacitor comprises an electrode formed on the first surface of said substrate and a grounded electrode formed on a second surface of said substrate.

4. Dielectric filter having a plurality of λ/4 coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first capacitor, one of two conductors of the first capacitor being electrically connected to the inner conductor at the other end surface of the resonator, said units being connected in series so that two neighboring units are electrically connected to each other in such a manner that the other conductor of the first capacitor of one of two neighboring units is electrically connected to the inner conductor at said one end surface of the resonator of the other unit, and the outer conductor of each resonator is grounded via a respective second capacitor.

5. Dielectric filter as set forth in claim 4, wherein all of said dielectric resonators are supported on a dielectric substrate.

6. Dielectric filter as set forth in claim 4, wherein all of said dielectric resonators are supported on a first surface of a dielectric substrate, and the second capacitor comprises an electrode formed on the first surface of said substrate and a grounded electrode formed on a second surface of said substrate.

7. Dielectric filter as set forth in claim 4, wherein all of said dielectric resonators are supported on a first surface of a dielectric substrate, and the first capacitor comprises a pair of electrodes formed on the first surface of said substrate.

8. Dielectric filter as set forth in claim 4, wherein the other conductor of the first capacitor of one of two neighboring units is directly connected to the outer conductor of the resonator of the other unit so that the other conductor of the first capacitor of one of two neighboring units becomes electrically connected to the inner conductor at said one end surface of the resonator of the other unit based on a short-circuit of the inner and outer conductors on said one end surface of the resonator of the other unit.

9. Dielectric filter having a plurality of λ/4 coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first inductor, one end of the first inductor being electrically connected to the inner conductor at the other end surface of the resonator, said units being connected in series so that two neighboring units are electrically connected to each other in such a manner that the other end of the first inductor of one of two neighboring units is electrically connected to the inner conductor at said one end surface of the resonator of the other unit, and the outer conductor of each resonator is grounded via a respective second inductor.

10. Dielectric filter as set forth in claim 9, wherein all of said dielectric resonators are supported on a dielectric substrate.

11. Dielectric filter as set forth in claim 9, wherein the other end of the first inductor of one of two neighboring units is directly connected to the outer conductor of the resonator of the other unit so that the other end of the first inductor of one of two neighboring units becomes electrically connected to the inner conductor at said one end surface of the resonator of the other unit based on a short-circuit of the inner and outer conductors on said one end surface of the resonator of the other unit.

12. Dielectric filter having a plurality of λ/4 coaxial dielectric resonators, each resonator having inner and outer conductors and being filled with a dielectric material between said inner and outer conductors, the inner and outer conductors being short-circuited at one end surface of each resonator, wherein the resonators are connected in series so that the inner conductor at said one end surface of one of two neighboring resonators is electrically connected to the inner conductor at the other end surface of the other resonator, and the outer conductor of each resonator is grounded via a respective inductor.

13. Dielectric filter as set forth in claim 12, wherein all of said dielectric resonators are supported on a first surface of a dielectric substrate, and the inductor comprises a pattern coil formed on the first surface of said substrate, and a grounded electrode electrically connected to said pattern coil is formed on a second surface of said substrate.

14. Dielectric filter as set forth in claim 12, wherein all of said dielectric resonators are supported on a dielectric substrate.

15. Dielectric filter having a plurality of λ/4 coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first capacitor, one of two conductors of the first capacitor being electrically connected to the inner conductor at the other end surface of the resonator, said units being connected in series so that two neighboring units are electrically connected to each other in such a manner that the inner conductor at said one end surface of the resonator of one of two neighboring units is electrically connected to the inner conductor at said one end surface of the resonator of the other unit, and the outer conductor of each resonator is grounded via the same second capacitor.

16. Dielectric filter as set forth in claim 15, wherein the outer conductor of the resonator of one of two neighboring units is directly connected to the outer conductor of the resonator of the other unit so that the inner conductor at said one end surface of the resonator of one of two neighboring units becomes electrically connected to the inner conductor at said one end surface of the resonator of the other unit based on a short-circuit of the inner and outer conductors on said one end surface of the resonator of both units.

17. Dielectric filter as set forth in claim 15, wherein all of said dielectric resonators are supported on a dielectric substrate.

18. Dielectric filter as set forth in claim 15, wherein all of said dielectric resonators are supported on a first surface of a dielectric substrate, and the second capacitor comprises an electrode formed on the first surface of said substrate and a grounded electrode formed on a second surface of said substrate.

19. Dielectric filter as set forth in claim 15, wherein all of said dielectric resonators are supported on a first surface of a dielectric substrate, and the first capacitor comprises a pair of electrodes formed on the first surface of said substrate.

20. Dielectric filter having a plurality of λ/4 coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first capacitor, one of two conductors of the first capacitor being electrically connected to the inner conductor at the other end surface of the resonator, said units being connected in series so that two neighboring units are electrically connected to each other in such a manner that, in one connection of the neighboring units, the inner conductor at said one end surface of the resonator of one of two neighboring units is electrically connected to the inner conductor at said one end surface of the resonator of the other neighboring unit, whereas, in the other connection, the other conductor of the first capacitor of one of two neighboring units is electrically connected to the inner conductor at said one end surface of the resonator of the other unit, and the outer conductor of each resonator in the neighboring units in relation to said one connection is grounded via the same second capacitor and the outer conductor of each resonator in the unit out of relation to said one connection is grounded via a respective second capacitor.

21. Dielectric filter as set forth in claim 20, wherein said plurality of units are three units, said three units being connected in series so that two neighboring units are electrically connected to each other in such a manner that, in one connection of the neighboring units, the inner conductor at said one end surface of the resonator of one of two neighboring units is electrically connected to the inner conductor at said one end surface of the resonator of the other neighboring unit, whereas, in the other connection, the other conductor of the first capacitor of one of two neighboring units is electrically connected to the inner conductor at said one end surface of the resonator of the other unit, and the outer conductor of each resonator in the neighboring units in relation to said one connection is grounded via the same second capacitor and the outer conductor of each resonator in the unit out of relation to said one connection is grounded via a respective second capacitor.

22. Dielectric filter as set forth in claim 20, wherein said plurality of units are four units, said four units being connected in series so that two neighboring units are electrically connected to each other in such a manner that, in one connection of the neighboring units, the inner conductor at said one end surface of the resonator of one of two neighboring units is electrically connected to the inner conductor at said one end surface of the resonator of the other neighboring unit, whereas, in the other two connections disposed at both sides of said one connection, the other conductor of the first capacitor of one of two neighboring units is electrically connected to the inner conductor at said one end surface of the resonator of the other unit, and the outer conductor of each resonator in the neighboring units in relation to said one connection is grounded via the same second capacitor and the outer conductor of each resonator in the unit out of relation to said one connection is grounded via a respective second capacitor.

23. Dielectric filter as set forth in claim 20, wherein, in said one connection, the outer conductor of the resonator of one of two neighboring units is directly connected to the outer conductor of the resonator of the other neighboring unit so that the inner conductor at said one end surface of the resonator of one of two neighboring units becomes electrically connected to the inner conductor at said one end surface of the resonator of the other neighboring unit based on a short-circuit of the inner and outer conductors on said one end surface of the resonator of both units, and, in said other connection, the other conductor of the first capacitor of one of two neighboring units is directly connected to the outer conductor of the resonator of the other unit so that the other conductor of the first capacitor of one of two neighboring units becomes electrically connected to the inner conductor at said one end surface of the resonator of the other unit based on a short-circuit of the inner and outer conductors on said one end surface of the resonator of the other unit.

24. Dielectric filter as set forth in claim 20, wherein all of said dielectric resonators are supported on a dielectric substrate.

25. Dielectric filter as set forth in claim 20, wherein all of said dielectric resonators are supported on a first surface of a dielectric substrate, and the second capacitor comprises an electrode formed on the first surface of said substrate and a grounded electrode formed on a second surface of said substrate.

26. Dielectric filter as set forth in claim 20, wherein all of said dielectric resonators are supported on a first surface of a dielectric substrate, and the first capacitor comprises a pair of electrodes formed on the first surface of said substrate.

27. Dielectric filter having at least three $\lambda/4$ coaxial dielectric resonators, each resonator having inner and outer conductors and being filled with a dielectric material between its inner and outer conductors, said inner and outer conductors being short-circuited at one end surface of each resonator, wherein at least three units are used, each unit comprising the resonator and a first capacitor, one of two conductors of the first capacitor being electrically connected to the inner conductor at the other end surface of the resonator, said units being connected in series so that two neighboring units are electrically connected to each other in such a manner that in at least one connection of the neighboring units, the other conductor of the first capacitor of one of two neighboring units is electrically connected to the inner conductor at said one end surface of the resonator of the other unit, and the outer conductor of each resonator is grounded via a respective second capacitor.

28. Dielectric filter as set forth in claim 27, wherein the other conductor of the first capacitor of one of two neighboring units is directly connected to the outer conductor of the resonator of the other unit so that the other conductor of the first capacitor of one of two neighboring units becomes electrically connected to the inner conductor at said one end surface of the resonator of the other unit based on a short-circuit of the inner and outer conductors on said one end surface of the resonator of the other unit.

29. Dielectric filter as set forth in claim 27, wherein all of said dielectric resonators are supported on a dielectric substrate.

30. Dielectric filter as set forth in claim 27, wherein all of said dielectric resonators are supported on a first surface of a dielectric substrate, and the second capacitor comprises an electrode formed on the first surface of said substrate and a grounded electrode formed on a second surface of said substrate.

31. Dielectric filter as set forth in claim 27, wherein all of said dielectric resonators are supported on a first surface of a dielectric substrate, and the first capacitor comprises a pair of electrodes formed on the first surface of said substrate.

32. Dielectric filter having at least three $\lambda/4$ coaxial dielectric resonators, each resonator having inner and outer conductors and being filled with a dielectric material between its inner and outer conductors, said inner and outer conductors being short-circuited at one end surface of each resonator, wherein at least three units are used, each unit comprising the resonator and a first capacitor, one of two conductors of the first capacitor being electrically connected to the inner conductor at the other end surface of the resonator, said units being connected in series so that two neighboring units are electrically connected to each other in such a manner that, in at least one connection of the neighboring units, the inner conductor at said one end surface of the resonator of one of two neighboring units is electrically connected to the inner conductor at said one end surface of the resonator of the other unit, and the outer conductor of each resonator in the neighboring units in relation to said at least one connection is grounded via the same second capacitor and the outer conductor of each resonator in the unit out of relation to said at least one connection is grounded via a respective second capacitor.

33. Dielectric filter as set forth in claim 32, wherein the outer conductor of the resonator of one of two neighboring units is directly connected to the outer conductor of the resonator of the other unit so that the inner conductor at said one end surface of the resonator of one of two neighboring units becomes electrically connected to the inner conductor at said one end surface of the resonator of the other unit based on a short-circuit of the inner and outer conductors on said one end surface of the resonator of both units.

34. Dielectric filter as set forth in claim 32, wherein all of said dielectric resonators are supported on a dielectric substrate.

35. Dielectric filter as set forth in claim 32, wherein all of said dielectric resonators are supported on a first surface of a dielectric substrate, and the second capacitor comprises an electrode formed on the first surface of said substrate and a grounded electrode formed on a second surface of said substrate.

36. Dielectric filter as set forth in claim 32, wherein all of said dielectric resonators are supported on a first surface of a dielectric substrate, and the first capacitor comprises a pair of electrodes formed on the first surface of said substrate.

37. Dielectric filter having a plurality of $\lambda/4$ coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first inductor, one end of the first inductor being electrically connected to the inner conductor at the other end surface of the resonator, said units being connected in series so that two neighboring units are electrically connected to each other in such a manner that the inner conductor at said one end surface of the resonator of one of two neighboring units is electrically connected to the inner conductor at said one end surface of the resonator of the other unit, and the outer conductor of each resonator is grounded via the same second inductor.

38. Dielectric filter as set forth in claim 37, wherein the outer conductor of the resonator of one of two neighboring units is directly connected to the outer conductor of the resonator of the other unit so that the inner conductor at said one end surface of the resonator of one of two neighboring units becomes electrically connected to the inner conductor at said one end surface of the resonator of the other unit based on a short-circuit of the inner and outer conductors on said one end surface of the resonator of both units.

39. Dielectric filter as set forth in claim 37, wherein all of said dielectric resonators are supported on a dielectric substrate.

40. Dielectric filter having a plurality of $\lambda/4$ coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first inductor, one end of the first inductor being electrically connected to the inner conductor at the other end surface of the resonator, said units being connected in series so that two neighboring units are electrically connected to each other in such a manner that, in one connection of the neighboring units, the inner conductor at said one end surface of the resonator of one of two neighboring units is electrically connected to the inner conductor at said one end surface of the resonator of the other neighboring unit, whereas, in the other connection, the other end of the first inductor of one of two neighboring units is electrically connected to the inner conductor at said one end surface of the resonator of the other unit, and the outer conductor of each resonator in the neighboring units in relation to said one connection is grounded via the same second inductor and the outer conductor of each resonator in the units out of relation to said one connection is grounded via a respective second inductor.

41. Dielectric filter as set forth in claim 40, wherein said plurality of units are three units, said three units being connected in series so that two neighboring units are electrically connected to each other in such a manner that, in one connection of the neighboring units, the inner conductor at said one end surface of the resonator of one of two neighboring units is electrically connected to the inner conductor at said one end surface of the resonator of the other neighboring unit, whereas, in the other connection, the other end of the first inductor of one of two neighboring units is electrically connected to the inner conductor at said one end surface of the resonator of the other unit, and the outer conductor of each resonator in the neighboring units in relation to said one connection is grounded via the same second inductor and the outer conductor of each resonator in the unit out of relation to said one connection is grounded via a respective second inhibitor.

42. Dielectric filter as set forth in claim 40, wherein said plurality of units are four units, said four units being connected in series so that two neighboring units are electrically connected to each other in such a manner that, in one connection of the neighboring units, the inner conductor at said one end surface of the resonator of one of two neighboring units is electrically connected to the inner conductor at said one end surface of the resonator of the other neighboring unit, whereas, in the other two connections disposed at both sides of said one connection, the other end of the first inductor of one of two neighboring units is electrically connected to the inner conductor at said one end surface of the resonator of the other unit, and the outer conductor of each resonator in the neighboring units in relation to said one connection is grounded via the same second inductor and the outer conductor of each resonator in the unit out of relation to said one connection is grounded via a respective second inductor.

43. Dielectric filter as set forth in claim 40, wherein, in said one connection, the outer conductor of the resonator of one of two neighboring units is directly connected to the outer conductor of the resonator of the other neighboring unit so that the inner conductor at said one end surface of the resonator of one of two neighboring units becomes electrically connected to the inner conductor at said one end surface of the resonator of the other neighboring unit based on a short-circuit of the inner and outer conductors on said one end surface of the resonator of both units, and, in said other connection, the other end of the first inductor of one of two neighboring units is directly connected to the outer conductor of the resonator of the other unit so that the other end of the first inductor of one of two neighboring units becomes electrically connected to the inner conductor at said one end surface of the resonator of the other unit based on a short-circuit of the inner and outer conductors on said one end surface of the resonator of the other unit.

44. Dielectric filter as set forth in claim 40, wherein all of said dielectric resonators are supported on a dielectric substrate.

45. Dielectric filter having at least three λ/4 coaxial dielectric resonators, each resonator having inner and outer conductors and being filled with a dielectric material between its inner and outer conductors, said inner and outer conductors being short-circuited at one end surface of each resonator, wherein at least three units are used, each unit comprising the resonator and a first inductor, one end of the first inductor being electrically connected to the inner conductor at the other end surface of the resonator, said units being connected in series so that two neighboring units are electrically connected to each other in such a manner that, in at least one connection of the neighboring units, the other end of the first inductor of one of two neighboring units is electrically connected to the inner conductor at said one end surface of the resonator of the other unit, and the outer conductor of each resonator is grounded via a respective second inductor.

46. Dielectric filter as set forth in claim 45, wherein the other end of the first inductor of one of two neighboring units is directly connected to the outer conductor of the resonator of the other unit so that the other end of the first inductor of one of two neighboring units becomes electrically connected to the inner conductor at said one end surface of the resonator of the other unit based on a short-circuit of the inner and outer conductors on said one end surface of the resonator of the other unit.

47. Dielectric filter as set forth in claim 45, wherein all of said dielectric resonators are supported on a dielectric substrate.

48. Dielectric filter having at least three λ/4 coaxial dielectric resonators, each resonator having inner and outer conductors and being filled with a dielectric material between its inner and outer conductors, said inner and outer conductors being short-circuited at one end surface of each resonator, wherein at least three units are used, each unit comprising the resonator and a first inductor, one end of the first inductor being electrically connected to the inner conductor at the other end surface of the resonator, said units being connected in series so that two neighboring units are electrically connected to each other in such a manner that, in at least one connection of the neighboring units, the inner conductor at said one end surface of the resonator of one of two neighboring units is electrically connected to the inner conductor at said one end surface of the resonator of the other unit, and the outer conductor of each resonator in the neighboring units in relation to said at least one connection is grounded via the same second inductor and the outer conductor of each resonator in the unit out of relation to said at least one connection is grounded via a respective second inductor.

49. Dielectric filter as set forth in claim 48, wherein the outer conductor of the resonator of one of two neighboring units is directly connected to the outer conductor of the resonator of the other unit so that the inner conductor at said one end surface of the resonator of one of two neighboring units becomes electrically connected to the inner conductor at said one end surface of the resonator of the other unit based on a short-circuit of the inner and outer conductors on said one end surface of the resonator of both units.

50. Dielectric filter as set forth in claim 48, wherein all of said dielectric resonators are supported on a dielectric substrate.

51. Dielectric filter having a plurality of λ/4 coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first capacitor, one of two conductors of the first capacitor being electrically connected to the inner conductor at the other end surface of the resonator, said units being connected in series so that two neighboring units are electrically connected to each other in such a manner that the inner conductor at said one end surface of the resonator of one of two neighboring units is electrically connected to the inner conductor at said one end surface of the resonator of the outer unit, the outer conductor of each resonator is grounded via a respective second capacitor, at least one additional unit is interposed between two neighboring units, said additional unit comprising at least two third capacitors connected in series, a connecting portion between two neighboring third capacitors is grounded via an additional λ/4 coaxial dielectric resonator, the additional dielectric resonator being filled with a dielectric material between its inner and outer conductors which are short-circuited at one end surface of the additional dielectric resonator, so that the connecting portion between two neighboring third capacitors is electrically connected to the inner conductor at the other end surface of the additional dielectric resonator and the outer conductor of the additional dielectric resonator is directly grounded.

52. Dielectric filter having plurality of λ/4 coaxial dielectric resonators, each resonator having inner and outer conductors and being filled with a dielectric material between its inner and outer conductors, said inner and outer conductors being short-circuited at one end surface of each resonator, wherein a plurality of units are used, each unit comprising the resonator and a first inductor, one end of the first inductor being electrically connected to the inner conductor at the other end surface of the resonator, said units being connected in series so that two neighboring units are electrically connected to each other in such a manner that the inner conductor at said one end surface of the resonator of one of two neighboring units is electrically connected to the inner conductor at said one end surface of the resonator of the other unit, the outer conductor of each resonator is grounded via a respective second inductor, at least one additional unit is interposed between two neighboring units, said additional unit comprising at least two third inductors connected in series, a connecting portion between two neighboring third inductors is grounded via an additional λ/4 coaxial dielectric resonator, the additional dielectric resonator being filled with a dielectric material between its inner and outer conductors which are short-circuited at one end surface of the additional dielectric resonator, so that the connecting portion between two neighboring third inductors is electrically connected to the inner conductor at the other end surface of the additional dielectric resonator and the outer conductor of the additional dielectric resonator is directly grounded.

* * * * *